United States Patent [19]

Kakinuma et al.

[11] 4,292,812

[45] Oct. 6, 1981

[54] CONTROL DEVICE FOR ICE MAKING MACHINE

[75] Inventors: Mitsuru Kakinuma, Sakaimachi; Yoshitaka Takahashi, Gumma, both of Japan

[73] Assignees: Sanyo Electric Co., Ltd.; Tokyo Sanyo Electric Co., Ltd., both of Osaka, Japan

[21] Appl. No.: 144,930

[22] Filed: Apr. 29, 1980

[30] Foreign Application Priority Data

May 2, 1979 [JP] Japan ..... 54-54494

[51] Int. Cl.[3] ..... F25C 1/00

[52] U.S. Cl. ..... 62/157; 62/233

[58] Field of Search ..... 62/157, 233, 211, 340, 62/66

[56] References Cited

U.S. PATENT DOCUMENTS

| | | | |
|---|---|---|---|
| 3,714,794 | 2/1973 | Linstromberg et al. | 62/233 X |
| 3,774,407 | 11/1973 | Bright | 62/233 X |
| 4,257,237 | 3/1981 | Hoenisch | 62/233 X |

*Primary Examiner*—William E. Tapolcai, Jr.
*Attorney, Agent, or Firm*—Darby & Darby

[57] ABSTRACT

The present application discloses a control device for an ice making machine to make ice by circulating ice-making water to an ice making member having a refrigerating system, said control device comprising a timer circuit to be operated simultaneously with or with a delay after the start of an ice making operation and adapted to control a period of time during which an ice making operation is performed, a temperature sensing element whose impedance varies with the variations of the ambient temperature around the refrigerating system, so that an input voltage applied to the timer circuit may vary with the variations of an impedance of the temperature sensing element, thereby to automatically control the period of time during which an ice making operation is performed, whereby the thickness of ice made when one cycle of an ice making operation is completed, may be maintained constant at all times.

According to the present invention, provision is made so that, if a condenser is clogged with dust or dirt, an indication is given of such clogging.

8 Claims, 4 Drawing Figures

CONTROL DEVICE FOR ICE MAKING MACHINE

FIELD OF THE INVENTION

The present invention relates to a control device for an ice making machine to make ice by circulating ice-making water to an ice making member having a refrigerating system, while maintaining constant at all times the thickness of ice made when one cycle of an ice making operation is completed.

BACKGROUND OF THE INVENTION

In a conventional method of making ice by circulating ice-making water to the ice making member having a refrigerating system, a period of time of an ice making operation has been controlled by a timer. According to such a conventional method, when a period of time preset to the timer has been long, ice having a relatively large thickness has been made, and when such preset time has been short, ice having a relatively smaller thickness has been made. However, even if a period of time preset to the timer has been suitable, the thickness of ice made has varied with the ambient temperature. It has therefore been impossible to make ice having a predetermined thickness.

DISCLOSURE OF THE INVENTION

In an ice making machine to make ice by circulating ice-making water to the ice making member having a refrigerating system, the present invention provides a control device comprising a timer circuit to be operated simultaneously with or with a delay after the start of an ice making operation and adapted to control a period of time during which an ice making operation is performed. There is also provided a temperature sensing element above impedance varies with the variations of the ambient temperature around the refrigerating system, so that an input voltage applied to the timer circuit varies with the variations of an impedance of the temperature sensing element. This invention is used to automatically control a period of time during which an ice making operation is performed, whereby the thickness of ice made when one cycle of an ice making operation is completed, may be maintained constant at all times.

According to the present invention, there is also provided an alarm means for informing of the occurrence of anything abnormal in a condenser of the refrigerating system. This alarm means is adapted to be operated when the temperature sensing element senses a predetermined high temperature. Namely, when the condenser is clogged with dust or dirt, the alarm means is adapted to inform of such clogging.

BRIEF DESCRIPTION OF THE DRAWINGS

The present invention will be now described by way of example, with reference to the accompanying drawings, in which.

DETAILED DESCRIPTION OF PREFERRED EMBODIMENTS

The description hereinafter will discuss an example of an ice making machine to which a control device in accordance with the present invention is applied, with reference to FIG. 1.

Figure 1:
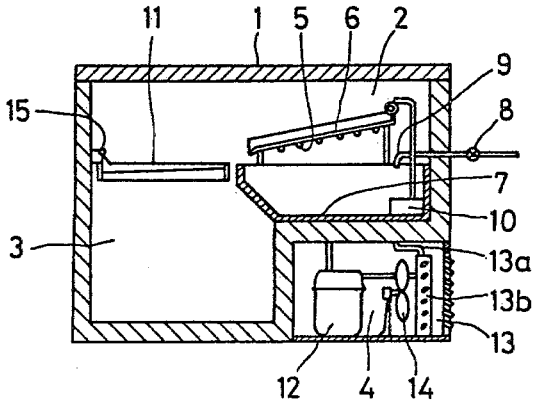
FIG. 1 is a section view of main portions of an ice making machine to which a control device in accordance with the present invention is applied.

FIG. 1 shows an ice making machine main body 1 formed by insulating walls which has an ice making chamber 2, an ice storage chamber 3 and a machinery chamber 4.

Disposed on an incline in the ice making chamber 2 is a stainless steel ice making member 6 having associated therewith a refrigerant evaporating pipe 5 of the refrigerating system.

Disposed under the ice making member 6 is a water storage tank 7 to store ice-making water. Ice-making water is supplied from a feed water pipe 9 to the water storage tank 7 with a feed water valve 8 opened during the time an ice removing operation is performed.

Disposed at the bottom of a water storage tank 7 is a pump means 10. This arrangement provides an ice making system of the flowing-water circulation type.

A plate ice cutting heater means 11 is disposed adjacent the lower end of the ice making member 6 and at the upper portion of the ice storing chamber 3. This heater means 11 is adapted to receive plate ice removed from the ice making member 6 to cut the same into blocks of predetermined size.

Disposed in the machinery chamber 4 are a motor compressor 12, a condenser 13 which includes a condensing pipe **13*a* and a fin 13*b*, and a fan 14 for forcibly air-cooling the condenser 13. The motor compressor 12 and condenser 13 constitute a refrigerating system together with the refrigerant evaporating pipe 5**.

An ice removal completion detector switch 15 is disposed adjacent the ice making member 6 for detecting the completion of an ice removing operation when plate ice drops to the heater means 11 from the ice making member 6.

The description hereinafter will discuss the electric circuit of a first embodiment of a control device in accordance with the present invention, with reference to FIG. 2.

Figure 3:
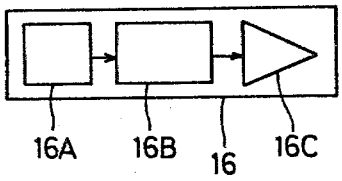
FIG. 3 is a block diagram of a timer circuit used in FIG. 2.

As shown in the schematic block diagram in FIG. 3, a timer circuit 16 includes an oscillator 16A, a counter circuit 16B and an output unit 16C. Through the oscillator 16A, the timer circuit 16 produces periodic pulses at a rate set both by a time constant determined by a capacitor 19 and a resistance 18 connected in series to the power terminals 17A and 17B of a direct current power supply, and by a voltage applied to an input terminal 20. Such pulse appear at an output terminal 21 through the output unit 16C, after having been counted in predetermined counts by the counter circuit 16B. Two resistances 22 and 23 are connected in series between the output terminal 21 and the power supply terminal 17B.

The armature of a first relay 24 and a transistor 25 are connected in series between the power supply terminals 17A and 17B, and the base of the transistor 25 is connected to the junction point of the resistances 22 and 23. The transistor 25 is adapted to be turned ON by an output pulse from the timer circuit 16.

According to the present invention, since the rate of the periodic pulses generated in the timer circuit 16 is set both by the time constant determined by the capacitor 19 and the resistance 18, and by a voltage applied to the input terminal 20, variations of the voltage applied to the input terminal 20 cause the rate of such periodic pulses to be changed, so that the generation time of an output pulse taken out from the output unit 16C of the timer circuit 16 is finally controlled.

A circuit for performing such control above-mentioned is formed as discussed in the following.

A resistance 26 and a diode 27 are connected in series across the power terminals 17A and 17B. The diode 27 serves as a temperature sensing element for detecting the variations of the ambient temperature around the refrigerating system. Namely, the diode 27 has a characteristic such that its impedance will increase when the ambient temperature is low and its impedance will decrease when the ambient temperature is high. This diode 27 is disposed, for example, at the outlet side of the condenser 13, at the high pressure side of which the temperature varies with the variations of the ambient temperature, and is adapted to sense the temperature of the condensing pipe 13*a*.

The junction point of the resistance 26 with the diode 27 is connected to the minus (inverting) input terminal 29 of an operational amplifier 28. A variable resistance 30 and a resistance 31 are connected in series across the power terminals 17A and 17B. The junction point of the variable resistance 30 with the resistance 31 is connected to the non-inverting input terminal 32 of the operational amplifier 28.

A negative feedback resistance 34 is connected between the output terminal 33 and the minus input terminal 29 of the operational amplifier 28. By applying a negative feedback to the minus input terminal 29 of the operational amplifier 28, the output voltage of the operational amplifier 28 becomes proportional to an input voltage applied to the operational amplifier 28.

Two resistances 35 and 36 are connected in series between the output terminal 33 of the operational amplifier 28 and the power terminal 17B. The junction point of the resistances 35 and 36 is connected to the input terminal 20 of the timer circuit 16.

Accordingly, variations of the voltage at the output terminal 33 of the operational amplifier 28 will appear at the input terminal 20 of the timer circuit 16, so that the generation time of an output pulse from the timer circuit 16 is controlled in response to the variations of the temperature of the condensing pipe 13*a*, or the variations of the ambient temperature, as determined by the variation of the impedance of the temperature sensing diode 27.

Two resistances 37 and 38 are connected in series across the power supply terminals 17A and 17B. The junction point of the resistances 37 and 38 is connected to the plus input terminal 41 of a comparator 40 through a resistance 39. The minus input terminal 42 of the comparator 40 is connected to the output terminal 33 of the operational amplifier 28 through a resistance 43. A positive feedback resistance 45 is connected between the output terminal 44 and the plus input terminal 41 of the comparator 40. Application of a positive feedback to the input terminal of the comparator 40 causes the comparator 40 to instantaneously generate an output voltage.

A resistance 46 and a light-emitting diode 47 are connected in series between the output terminal 44 of the comparator 40 and the power supply terminal 17B. This light-emitting diode 47 has a function as an alarm means adapted to be operated when the condenser 13 is clogged with dust, dirt or the like. When the diode 27 senses a predetermined high temperature of the condensing pipe 13*a*, for example, a temperature about 60° C. which high temperature may exert a damaging effect upon the motor compressor 12 or the other, a voltage of a predetermined level is generated at the output terminal 33 of the operational amplifier 28. At this time, an output voltage is generated at the output terminal 44 of the comparator 40 and subsequently the light-emitting diode 47 comes on.

A Zener diode 48 is connected across the power supply terminals 17A and 17B to regulate the power supply voltage.

The primary winding of a transformer 50 is connected to the power terminals 49A and 49B of an alternating current (AC) power supply. The secondary winding of the transformer 50 is connected, through a fuse 51, to the heater means 11 for the ice cutting plate.

The normally open contact 24*a* of the first relay 24, the armature of a second relay 52 and the ice removal completion detector switch 15 are connected in series across the AC power terminals 49A and 49B. The second relay 52 has a normally open self-maintaining contact 52*h*. The power terminal 17A of the direct current power supply has a normally closed reset contact 52*r* controlled by the second relay 52. This reset contact 52*r* is adapted to reset the function of the timer circuit 16.

The pump means 10 and a fan motor 53 for the fan 14 are connected in parallel across the AC power supply terminals 49A and 49B through the normally closed contact 52*b* of the second relay 52. The feed water valve 8 and a hot gas valve 54 are connected in parallel across the AC power supply terminals 49A and 49B, through the normally open contact 52*a* of the second relay 52. The motor compressor 12 is also connected across the AC power supply terminals 49A and 49B.

The description hereinafter will discuss the operation of the embodiment of the present invention above-mentioned.

The description will first be made of a circuit operable to make the thickness of ice uniform.

When the direct current power supply and the alternating current power supply are turned ON, the motor compressor 12 starts operating to cool the ice making member 6. At the same time, the pump means 10 and the fan motor 53 are energized through the normally close contact 52*b* of the second relay 52, thereby to supply ice-making water in the water storage tank 7 to the ice making member 6, thus starting an ice making operation.

The period of time during which an ice making operation is performed, varies with the temperature condition of the condensing pipe 13*a* which is detected by the diode 27. Namely, when the temperature of the condensing pipe 13*a* is high, the impedance of the diode 27 becomes small and the voltage across the terminals of the diode 27 is small. Accordingly, the potential difference between the plus input terminal 32 and the minus input terminal 29 of the operational amplifier 28 is large and a voltage at the output terminal 33 of the operational amplifier 28 is increased, thereby to increase the voltage applied to the input terminal 20 of the timer circuit 16. Therefore, the interval between the periodic pulses from the oscillator 16A becomes long. As the result, the generation time of an output pulse from the output unit 16C is delayed.

On the other hand, when the temperature of the condensing pipe 13*a* is low, the impedance of the diode 27 becomes large and the voltage across the both terminals of the diode 27 is high. Accordingly, the potential difference between the plus input terminal 32 and the minus input terminal 29 of the operational amplifier 28 is small and the voltage at the output terminal 33 of the operational amplifier 28 is reduced, thereby to drop the voltage applied to the input terminal 20 of the timer circuit 16. This causes, the interval between periodic pulses from the oscillator 16A to decrease. As the result, the generation time of an output pulse from the output unit 16C is advanced.

In both cases above-mentioned, the output pulse from the output unit 16C of the timer circuit 16 is used to turn ON the transistor 25. The first relay 24 is subsequently energized and its normally open contact **24*a* is closed to thereby energize the second relay 52. By such energization, the self-maintaining contact 52*h* of the second relay 52 is closed so that the second relay 52 is self-maintained, and the reset contact 52*r* is opened to reset the timer circuit 16** to a status ready for the next cycle.

Concerning the second relay 52, its normally closed contact **52*b* is opened and its normally open contact 52*a* is closed, so that the pump means 10 and the fan motor 53 stop operating, thereby to complete the ice making operation. Then, the hot gas valve 54 and the feed water valve 8 operate to flow a hot gas of the refrigerating system to the refrigerant evaporating pipe 5, thereby to start an ice removal operation to remove plate ice frozen on the ice making member 6. At this time, water necessary to the next cycle ice making operation is fed to the water storage tank 7**.

When the ice removal completion detector switch 15 detects the removal of the plate ice from the ice making member 6, the switch contact is opened to release, or de-energize, the second relay 52. Then, the normally open contact **52*a* is again switched to the normally closed contact 52*b*, thereby to start the next cycle of an ice making operation. The self-maintaining contact 52*h* and the reset contact 52*r* of the second relay 52** are also reset to the normal status, whereby the operation discussed earlier is repeated.

In summary, when the temperature of the condensing pipe **13*a* is high, that is, the ambient temperature is high, a period of time of an ice making operation to be controlled by the timer circuit 16 becomes greater, and when the temperature of the condensing pipe 13*a* is low, that is, the ambient temperature is low, a period of time of an ice making operation to be controlled by the timer circuit 16 becomes shorter. As the result, it is possible to make constant the thickness of ice made when an ice making operation of one cycle is completed, regardless of the variations of the temperature of the condensing pipe 13*a***, i.e. the variations of the ambient temperature.

A description will now be made of a circuit operable when the condenser 13 is clogged with dust, dirt or other foreign material.

When the fin **13*b* of the condenser 13 gets clogged with dust, dirt or other material, radiation of heat from the condenser 13 is reduced and the temperature of the condensing pipe 13*a* is increased. The output voltage from the operational amplifier 28 is then increased and thus increased voltage is applied to the minus input terminal 42 of the comparator 40. However, no voltage is supplied from the comparator 40 until the temperature of the condensing pipe 13*a* reaches a predetermined high temperature, for example about 60° C. When the diode 27 senses a predetermined high temperature, for example 60° C., and a voltage at the output terminal 33 of the operational amplifier 28 is applied to the minus input terminal 42 of the comparator 40, the potential difference between the minus input terminal 42 and the plus input terminal 41 causes the comparator 40 to generate a voltage at the output terminal 44, thereby to turn ON the light-emitting diode 47 to inform that the condenser 13** is clogged with dust or dirt.

When the condenser 13 is not clogged with dust or dirt, the temperature of the condensing pipe **13*a* usually never reaches 60° C. even though the ambient temperature reaches around 40° C. Therefore, there is no possibility of the light-emitting diode 47** erroneously coming on only by the influence of the ambient temperature.

In the embodiment discussed hereinbefore, the temperature sensing element, i.e. the diode 27 senses directly the temperature of the condensing pipe **13*a* as a high pressure side condensing temperature of the refrigerating system. However, it is also possible to indirectly sense the temperature of the fin 13*b* forming a portion of the condenser 13. The temperature sensing element is not limited only to the diode 27**, but a thermistor having a positive or negative characteristic, a transistor or other similar temperature sensing device may also be used as a temperature sensing element.

Besides the light-emitting diode 47, a lamp or a buzzer may be used as an alarm means.

In addition to the plate-type ice making machine discussed in the embodiment above-mentioned, the present invention may also be effectively applied to ice making machines of various air-cooling types, such as a so-called cell-type ice making machine.

The description hereinafter will discuss the electric circuit diagram of another embodiment of the present invention, with reference to FIG. 4.

Figure 2:
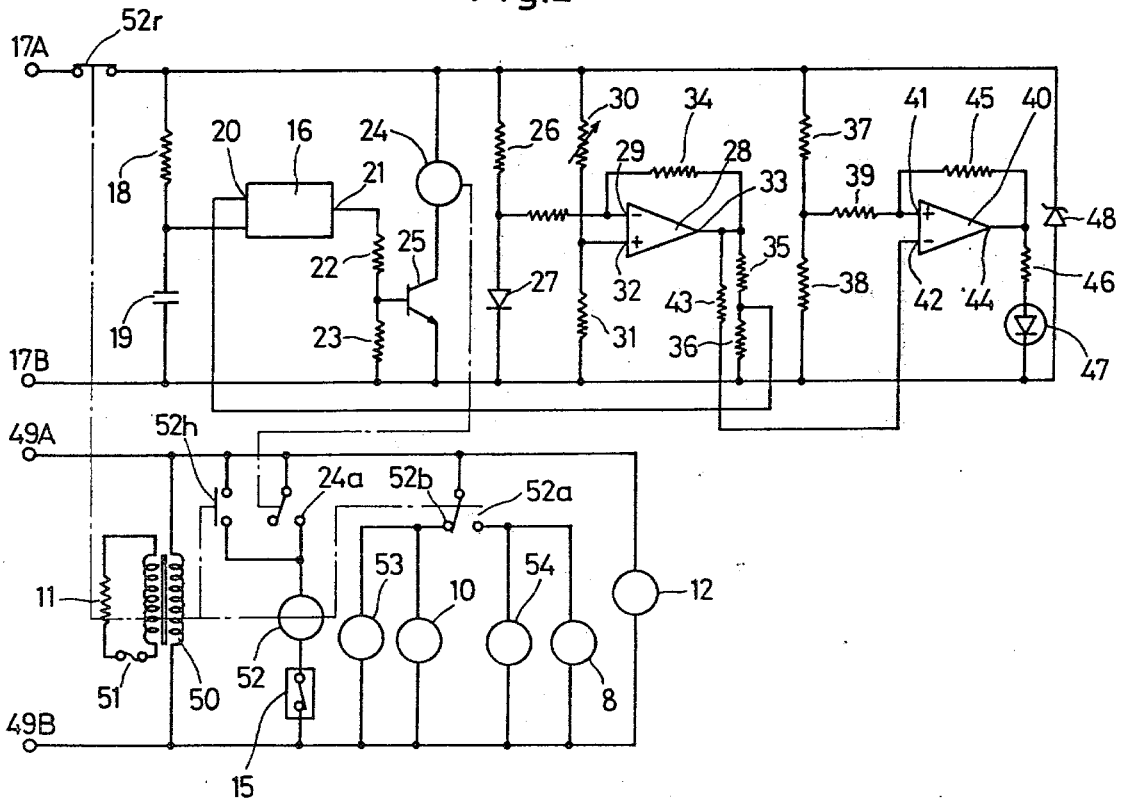
FIG. 2 is an electric circuit of a first embodiment of the control device in accordance with the present invention.
Figure 4:
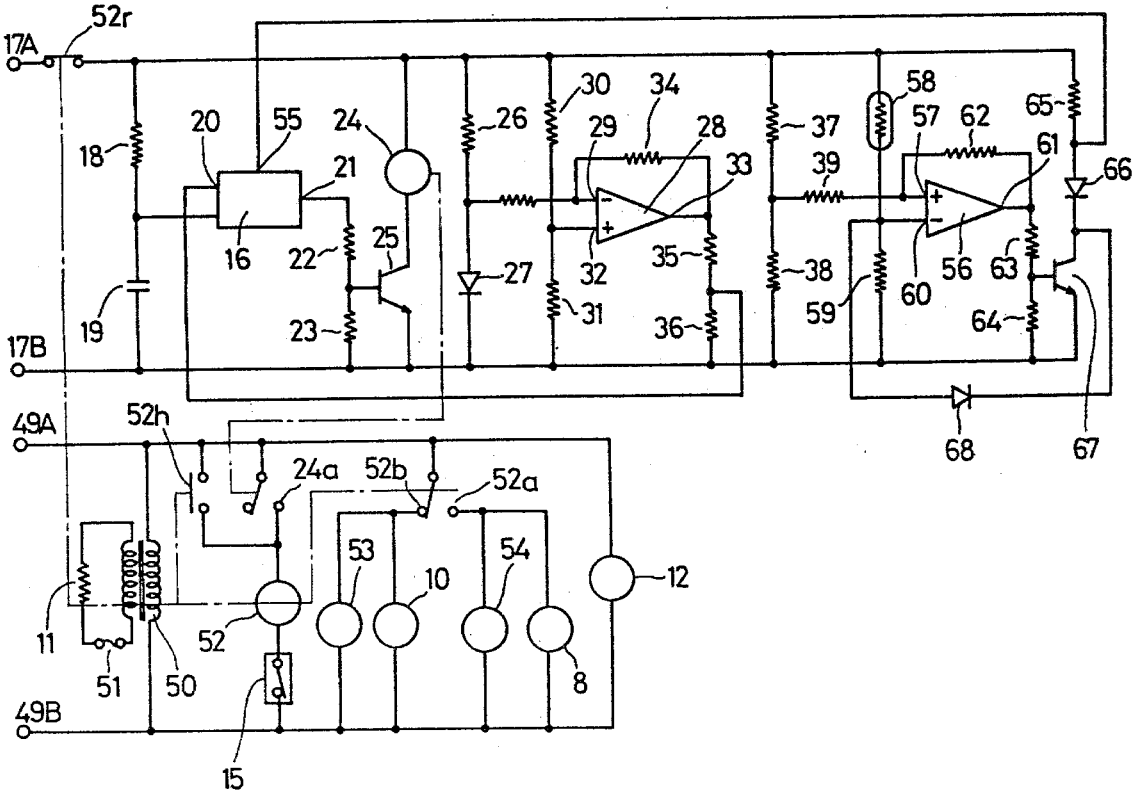
FIG. 4 is an electric circuit of a second embodiment of the present invention.

In FIG. 4, like parts are designated by like numerals used in FIG. 2.

A timer circuit 16 has an oscillation stop terminal 55. When this oscillation stop terminal 55 is supplied a high voltage level signed, the oscillator stops oscillating, and when this oscillation stop terminal is supplied with a low voltage level signal, say 0 V, the oscillator starts oscillating. The oscillation stop terminal 55 is connected to the output terminal of a switching circuit 56 to be discussed later and is adapted to suitably control the timer circuit 16.

The junction point of two resistances 37 and 38 connected in series across the power supply terminals 17A and 17B of the direct current power supply, is connected to the plus input terminal 57 of the switching circuit 56 through a resistance 39. A thermistor 58 and a resistance 59 are connected in series across the power supply terminals 17A and 17B, and the junction point of the thermistor 58 and the resistance 59 is connected to the minus input terminal 60 of the switching circuit 56. The thermistor 58 serves as a water temperature detector element for detecting the variations of the temperature of water in a water storage tank 7.

A positive feedback resistance 62 is connected between the plus input terminal 57 and the output terminal 61 of the switching circuit 56. By this positive feedback resistance 62, the switching circuit 56 is instantaneously turned ON. Two resistances 63 and 64 are connected in series between the output terminal 61 and the power terminal 17B.

A resistance 65, a diode 66 and a transistor 67 are connected in series across the power supply terminals 17A and 17B. The junction point of the resistance 65 with the diode 66 is connected to the oscillation stop terminal 55 of the timer circuit 16, and the base of the transistor 67 is connected to the connected point of the resistances 63 and 64. The connected point of the thermistor 58 with the resistance 59 is connected to the collector of the transistor 67 through a diode 68, so that oscillation in the timer circuit 16 is controlled by the operational status of the transistor 67.

The diode 68 operates such that output from the switching circuit 56 is not interrupted when the water level in the water storage tank 7 considerably varies and the thermistor 58 is exposed on the water surface during the ice making operation. Values of the resistances 37, 38 and 59 are preset such that output from the switching circuit 56 is inverted, when the thermistor 58 detects that the temperature of water fed to the water storage tank 7 is being lowered to a predetermined low temperature, namely, to a temperature slightly higher than the freezing point.

The operation of the embodiment of the present invention shown in FIG. 4 is described below.

When the power supplies are turned ON and the temperature of water in the water storage tank 7 is higher than a predetermined temperature, the transistor 67 is turned OFF and the oscillation stop terminal 55 of the timer circuit 16 has high voltage level. Therefore, oscillation is stopped and the timer circuit 16 is not operable.

On the other hand, the motor compressor 12 operates to start cooling the ice making member 6, and pump means 10 and the fan motor 53 are energized through a normally close contact **52*b* of a second relay 52, thereby to start an ice making operation for circulating ice-making water in the water storage tank 7 to the ice making member 6. At the beginning, ice-making water downwardly flowing on the ice making member 6 performs heat-exchange with said ice making member 6, so that the temperature of the ice-making water is lowered. Such ice-making water is then returned again to the water storage tank 7. By repetition of such circulation of ice-making water, the temperature of the ice-making water approaches the freezing point, and the ice-making water gradually grows as ice on the ice making member 6**.

Meanwhile, the thermistor 58 as the water temperature detector element detects the variations of the water temperature. When the thermistor 58 detects a predetermined low temperature of ice-making water, the thermistor 58 turns ON the switching circuit 56 to generate at its output terminal 61 a voltage, by which the transistor 67 is turned ON. Accordingly, the oscillation stop terminal 55 of the timer circuit 16 becomes low (0 V) and subsequently the timer circuit 16 starts operating.

After the timer circuit 16 has started operating, the timer operating period of time may variably be set according to the ambient temperature detected by the diode 27, as previously described. That is, when the ambient temperature is high, the impedance of the diode 27 becomes low and the terminal voltage of the diode 27 is low. Accordingly, as discussed hereinbefore, the potential difference between the plus input terminal 32 and the minus input terminal 29 of the operational amplifier 28 becomes large and the voltage at the output terminal 33 of the operational amplifier 28 is increased, so that the voltage applied to the input terminal 20 of the timer circuit 16 is increased. Therefore, the interval between periodic pulses from the oscillator 16A becomes longer. As the result, the generation time of an output pulse from the output unit 16C is delayed.

On the other hand, when the ambient temperature is low, the voltage at the output terminal 33 of the operational amplifier 28 decreases and the voltage applied to the input terminal 20 of the timer circuit 16 is also decreased. Accordingly, the interval between periodic pulses from the oscillator 16A is decreased. As a result, the generation time of an output pulse from the output unit 16C is advanced.

In any of the cases above-mentioned, when an output pulse is taken out from the output circuit 16C, the transistor 25 is turned ON and the first relay 24 is energized. The normally open contact **24*a* is then closed to energize the second relay 52. Thereafter, the same operations as those discussed in connection with the embodiment shown in FIG. 2**, are performed.

In summary, as the temperature of water in the water storage tank 7 becomes higher, the period of time necessary to turn ON the transistor 67 by an output voltage from the switching circuit 56 becomes longer, thereby to lengthen the period of time from the start of an ice making operation to the start of the operator of the timer circuit 16.

On the contrary, as the water temperature becomes lower at the water feed time, the period of time necessary to turn ON the transistor 67 by an output voltage from the switching circuit 56 becomes shorter, thereby to shorten the period of time from the start of an ice making operation to the start of the timer circuit 16.

On the other hand, when, for example, the ambient temperature is high after the timer circuit 16 has started, the timer operating period of time is lengthened to delay the ice making operation completion time. When the ambient temperature is low, the timer operating period of time is shortened to advance the ice making operation completion time. Namely, a total amount of time of the period of time from the ice making operation start to the timer circuit start and the timer operating period of time, is a substantial period of time during which an ice making operation is performed. Accordingly, when the water temperature is high and the ambient temperature is high at the water feed time, the period of time of an ice making operation is lengthened, and when the water temperature is low and the ambient temperature is low at the water feed time, the period of time of an ice making operation is shortened. This results in making ice having a constant thickness regardless of the water temperature and the ambient temperature at the water feed time.

INDUSTRIAL UTILITY

As thus discussed hereinbefore, according to the control device for an ice making machine of the present invention, an input voltage applied to the timer circuit varies with the variations of an impedance of the temperature sensing element for detecting the ambient temperature, thereby to control a period of time during which an ice making operation is performed, whereby the thickness of ice made when one cycle of the ice making operation is completed, may be maintained constant at all times.

Furthermore, according to the present invention, provision is made so that, even if the condenser is clogged with dust, dirt or the like, such clogging may be informed.

Moreover, one temperature sensing element may be utilized both for changing a period of time during which an ice making operation is performed, and for detecting that the condenser is being clogged with dust or dirt.

In addition, the water temperature detecting element for detecting the temperature of circulating ice-making water to an ice-making member permits to make the ice thickness constant regardless of the water temperature at the water feed time.

What we claim is:

1. In a control device for an ice making machine to make ice by circulating ice-making water to an ice making member having a refrigerating system, control device comprising a timer circuit to be operated to control a period of time during which an ice making operation is performed, and a temperature sensing element whose impedance varies with the variations of temperature for sensing an operating condition of said refrigerating system, so that an input voltage applied to said timer circuit varies with the variations of an impedance of said temperature sensing element, thereby to automatically control the period of time during which an ice making operation of one cycle is performed.

2. A control device for an ice making machine as set forth in claim 1, wherein said temperature sensing element senses the temperature of the refrigerant at the high pressure side of the refrigerating system.

3. A control device for an ice making machine as set forth in claim 1, wherein the timer circuit starts operating simultaneously with the start of an ice making operation.

4. A control device for an ice making machine as set forth in claim 1, further comprising an alarm means for indicating the occurrence of an abnormal condition in the condenser of the refrigerating system, said alarm means adapted to be operated when the temperature sensing element detects a predetermined high temperature.

5. A control device for an ice making machine as set forth in claim 1, further comprising for means for cooling a condenser in the refrigerating system.

6. A control device for an ice making machine as set forth in claim 1, further comprising a water temperature detecting element for detecting the variations of the temperature of circulating ice-making water to the ice-making member, the timer circuit adapted to be operated by a signal representing that said water temperature detecting element is detecting a predetermined low temperature.

7. A control device as in claim 1 wherein said temperature sensing element senses the refrigerant temperature at the low pressure side of the refrigerating system.

8. A control device as in claim 1 wherein said temperature sensing element senses the ambient temperature.

* * * * *